United States Patent [19]

De Filippi

[11] Patent Number: 4,941,796

[45] Date of Patent: Jul. 17, 1990

[54] FRONT LOADING REFUSE VEHICLE

[76] Inventor: Quinto De Filippi, 29 Edenvalley Drive, Islington, Ontario, Canada, M9A 4Z5

[21] Appl. No.: 299,469

[22] Filed: Jan. 23, 1989

[30] Foreign Application Priority Data

Apr. 29, 1988 [CA] Canada ..... 565609

[51] Int. Cl.[5] ..... B65F 3/02; B65F 3/04; B65F 3/14

[52] U.S. Cl. ..... 414/409; 414/517; 414/525.2

[58] Field of Search ..... 414/409, 407, 406, 408, 414/422, 425, 517, 516, 525.2, 525.3

[56] References Cited

U.S. PATENT DOCUMENTS

| | | | |
|---|---|---|---|
| 3,207,344 | 9/1965 | Clar | 414/409 |
| 3,282,453 | 11/1965 | Wood | 414/422 |
| 3,324,866 | 6/1967 | Davis | 414/409 |
| 3,762,586 | 10/1973 | Updike | 414/408 |
| 3,905,497 | 9/1975 | Steadman et al. | 414/408 |
| 4,173,424 | 11/1979 | Whitehead et al. | 414/517 |
| 4,538,951 | 9/1985 | Yeagel et al. | 414/407 |
| 4,627,783 | 12/1986 | De Filippi | 414/517 |
| 4,726,281 | 2/1988 | De Filippi | 91/167 R |
| 4,877,366 | 10/1989 | De Filippi | 414/517 |

*Primary Examiner*—David H. Brown

[57] ABSTRACT

A front loading refuse vehicle used with a refuse receptacle, the vehicle having a cab, and a rear body to carry refuse, and having rails located on either side of the cab, and extending upwardly and rearwardly over the cab, lifting arms adapted to engage the receptacle and lift it, carriages running on the rails and on which the lifting arms are moveably mounted, lifting arm power cylinders operable to swing the lifting arms away from and towards the rails, hoist arms pivotally mounted on the vehicle, for swinging forwardly and upwardly, hoist arm power cylinders for operating the hoist arms, hoist linkages connecting between the hoist arms and the carriages, operation of the hoist arms causing the carriages to move along the rails.

4 Claims, 2 Drawing Sheets

FRONT LOADING REFUSE VEHICLE

Figure 1:
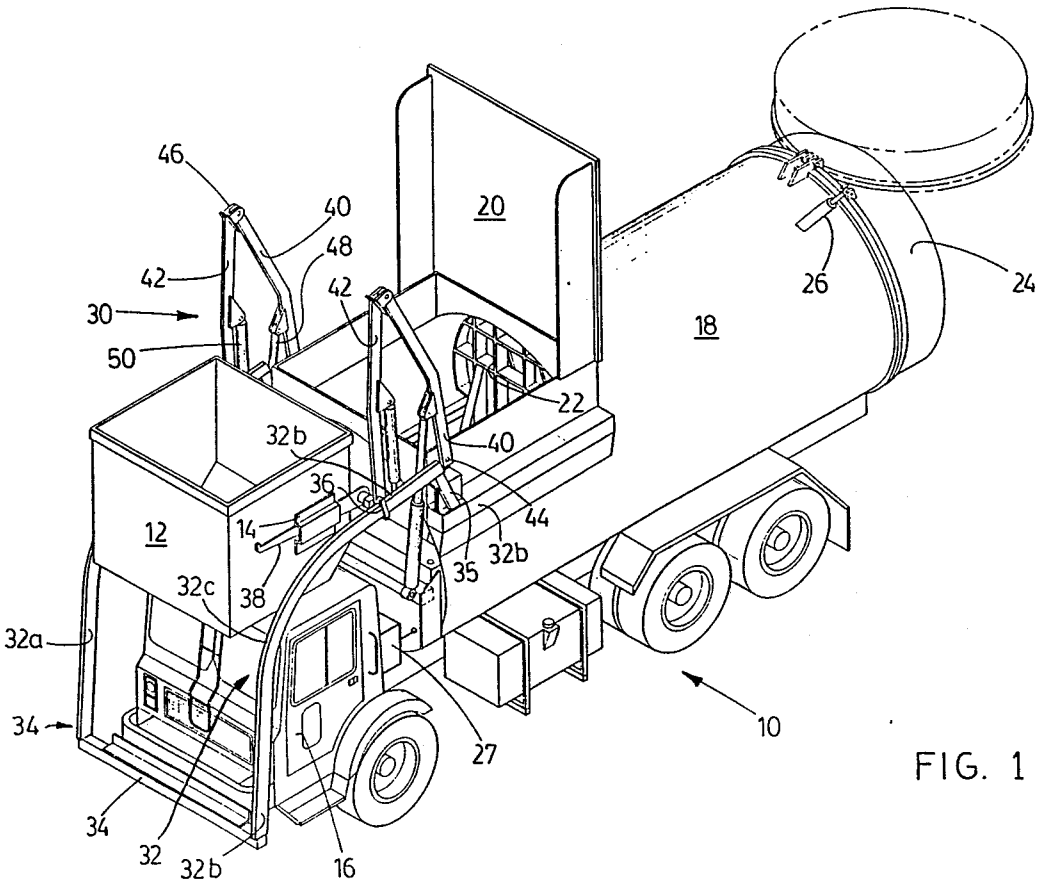

The invention relates to a front loading refuse vehicle, of the type wherein a refuse receplacle is raised and lowered over the cab of the vehicle, for dumping into the vehicle body.

BACKGROUND OF THE INVENTION

Front loading refuse vehicle are used by contractors who employ a number of refuse receptacles, which are placed at various work sites where refuse is collected in them.

At regular intervals the vehicle with a container body and hoist will visit the site, and engage and lift the receptacle up over the cab of the vehilce. The receptacle in then inverted over the container body of the vehicle and refuse is dumped into the body through a trap door in the top of the body.

The receptacle is then replaced on the ground. Various different mechanisms have been proposed for lifting and tipping the refuse receptacles. Almost all of them employ two arms which can be extended forwardly of the vehicle. The two arms are adapted to be introduced into two sleeves, one on either side of the receptacle. In this way, the receptacle can be raised and tipped by the lifting mechanism or hoist.

Various different problems arise in the designing of such a mechanism and indeed the entire refuse vehicle.

For any given vehicle chassis, the weight of the lifting mechanism or hoist, is a factor in the pay load which the vehicle can carry. The heavier the hoist, the less the pay load.

Some hoisting mechanisms are more difficult to operate than others, and some hoisting mechanisms are more easily damaged than others.

In addition, the hoists are operated by hydraulic cylinders. The design of the hoist, as well as its weight, may be a factor in determining the size of the hydraulic cylinders required for its operation. Clearly, a lighter hoist, and a more efficiently designed hoist, will make more effective use of energy, thereby reducing fuel consumption, and speeding up the operation. One type of hoisting mechanism involves the use of two rails or ramps permanently attached to the front of the vehicle and curving rearwardly over the cab. Two arms are provided, which can be extended forwardly to engage sleeves on either side of the refuse receptacle. In this type of hoist, the two arms are mounted on rollers which roll on the rail, and thus follow a pre-determined fixed track from the front of the vehicle upwardly and over the cab, towards the trap door in the vehicle body. This system permits the design of the hoisting linkage to the substantially simpler, and also it can be fabricated out of lighter gauge steel.

One particular system of this type however uses the trap door on top of the vehicle body as part of the hoisting linkage. This system involves a penalty in the loss of mechanical efficiency, and the entire linkege extends up to a considerable height in order to rotate and dump the actual receptacle.

Accordingly, while this system has achieved considerable popularity, it fails to take full advantage of the principals on which it is based.

BRIEF SUMMARY OF THE INVENTION

With a view to overcoming the various problems noted above, the invention comprises a front loading refuse vehicle of the type used in connection with a refuse receptacle at a refuse collection site, said vehicle comprising a front portion including a cab, and a rear container body portion adapted to carry refuse, rail means located on either side of said front portion, and extending upwardly therefrom and rearwardly over said cab, lifting carriage means adapted to run on said rail means, lifting arms adapted to engage said receptacle and lift the same, said lifting arms beingf moveably mounted on said carriage means, lifting arm power means operable to swing said lifting arms away from and towards said rail means, hoist arms pivotally mounted on said vehicle front portion, or swinging forwardly and upwardly, hoist arm power means for operating said hoist arms, hoist linkage means connecting between said hoist arms and said carriage means, whereby operation of said hoist arms will cause said carriage means to move along said rial means.

More particularly, it is an objective of the present invention to provide a front loading refuse vehicle having the foregoing advantages wherein said lifting arm power means is operatively connected to said hoist linkage means.

More particularly, it is an objective of the invention to provide a front loading refuse vehicle having the foregoing advantages wherein said hoist arms are pivotally mounted adjacent the rearward portions of said rail means.

More particularly, it is an objective of the invention to provide a front loading refuse vehicle having the foregoing advantages wherein hoist support frame means are provided rearwardly of said cab, for supporting said rail means.

More particularly, it is an objective of the present invention to provide a front loading refuse vehicle having the foregoing advantages, and including a refuse container body on said vehicle, a trap door at a forward end of said container body, refuse compaction means within said body, and wherein said trap door defines a forward edge, said hoist arm means being pivotally mounted adjacent said forward edge of said trap door.

More particularly, it is an objective of the present invention to provide a refuse vehicle having the foregoing advantages including trap door power means for operating said trap door, said trap door power means being independent of said hoist arms.

The various features of novelty which characterize the invention are pointed out with more particularly in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 1 is a general perspective illustration of a front loading refuse vehicle incorporating the invention, and

Figure 2:
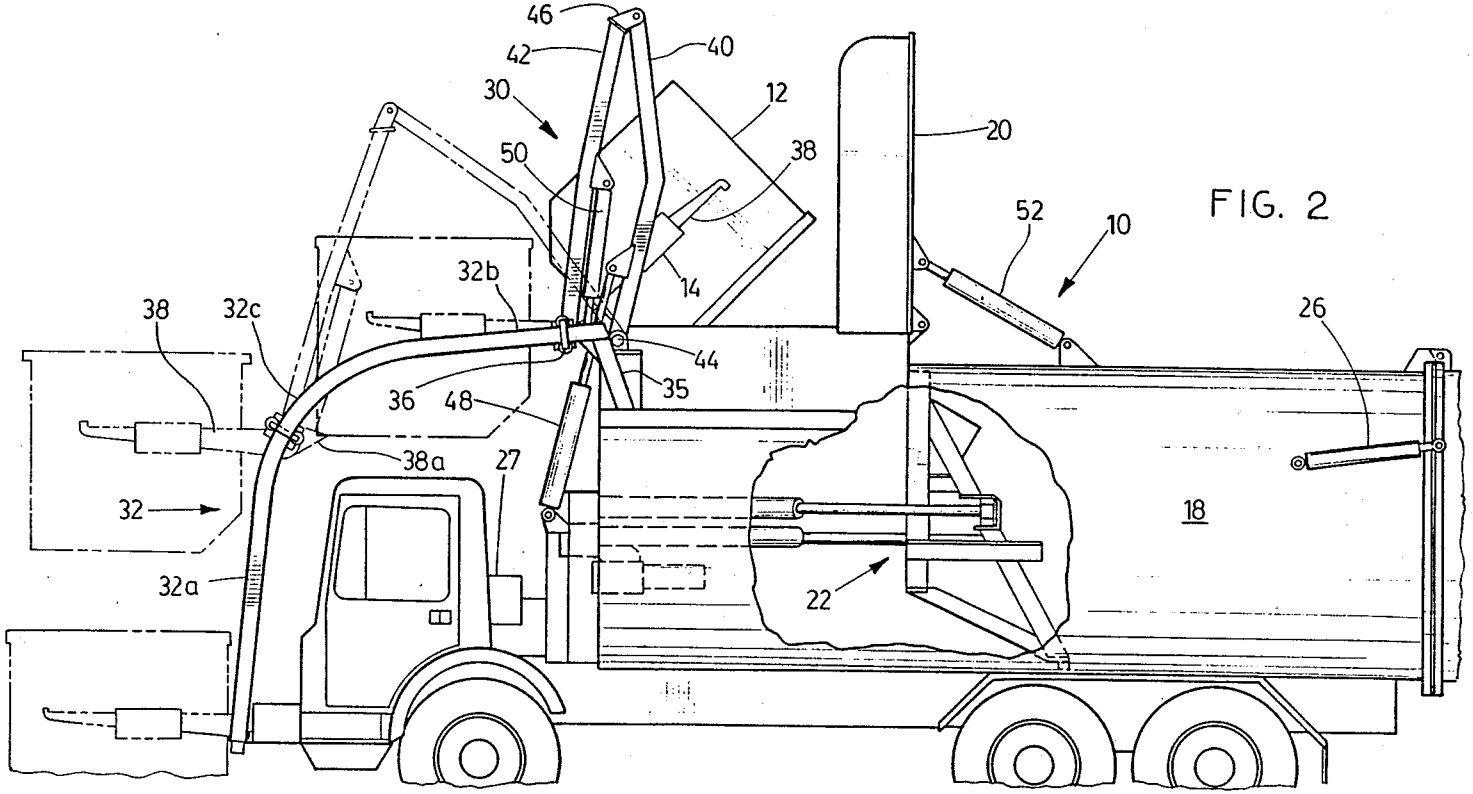

,

FIG. 2 is an enlarged side elevation of the forward portion of the refuse vehicle of FIG. 1.

Referring first of all to FIG. 1, the invention will be seen to be illustrated with reference to a front loading refuse vehicle of the type adapted to be used with a free standing static refuse receptacle. The refuse vehicle is indicated generally as 10, and the free standing receptacle is indicated generally as 12. Refuse receptacles of this general type are well known in the art, and simply consist of rectangular boxes having an open top with or without a lid. Typically they will be provided with sleeves 14 on either side by means of which they may be picked up, hoisted on top of the refuse collection vehicle and tipped over for dumping the contents.

The refuse vehicle 10 will be seen to have the usual driver's cab 16 at the front end, and in this embodiment has a refuse container body 18 mounted on the bed of the vehicle.

The body 18 has a trap door indicated generally as 20, on the front end of its top surface through which refuse from the receptacle 12 may be dumped.

Within the body 16 any suitable form of refuse compactor and ejection mechanism indicated generally as 22, shown partly in phantom, is provided by means of which the refuse may be compacted to increase the pay load.

As the rear end of the body 16, a swingable rear ejection door 24 operated by door cylinder 26 is provided through which the contents may be ejected at a dump site.

The vehicle has the usual hydraulic control 27 for operation of the various cylinders.

Various different forms of vehicle bodies, compactors and ejection doors may be provided in different designs without departing from the scope of the invention.

In order to raise and tip the receptacles 12, the vehicle 10 is provided with a front end hoisting mechanism indicated generally as 30.

Mechanism 30 comprises rail means which in this case are provided by a pair of rails 32–32. The rails 32 are located on opposite sides of the front end of the vehicle, and are fastened at their lower ends typically on a cross bar 34 attached to the vehicle frame. The rails 32 comprise forward upright portions **32*a* which extend upwardly, rearward sloping portions 32*b* which extend rearwardly over the roof of the cab and curved intermediate portions 32*c*. The rearward end of the rail portions 32*b* may be supported on hoist arm frame means 35 attached for example to the container body 16**.

Moveably mounted on the rails 32, are roller carriages 36. The carriages 36 consist of plates, having rollers engaging both edges of each of the rails 32. Swingably mounted on the carriages 36 are lifting arms 38. The arms are shaped and dimensioned so that they may be slid in and out of the sleeves 14 on the refuse receptacle 12 for the purpose of lifting it and tipping it and lowering it once more.

In order to move the roller carriages along the rails, a two part mechanism is provided comprising hoist arms 40 and hoist linkages 42. The hoist arms are pivotally mounted at 44, in this embodiment to the rearward end of the rails. It will, however, be appreciated that they could be mounted elsewhere on the vehicle independent of the rail.

At their upper ends, the hoist arms 40 are pivotally mounted at 46 to the hoist linkages 42. The hoist linkages are in turn pivotally connected to the roller carriages 36. Hoist arms 40 are dimensioned to extend substantially to reach the curved intermediate portions **32*c* of rails 32. Linkages 42 are dimensioned to have substantially the same length and to extend downwardly to substantially reach the lower ends of portions 32*a* of rails 32**.

Hoist arm power means consisting of hydraulic cylinders 48 are provided connected more or less midway along the hoist arms 40. The opposite ends of the cylinders are pivotally mounted rearwardly of the cab. Hoist arms 40 are swingable between forward more or less horizontal positions, and upward positions in which they are at least perpendicular and in fact swing just past the vertical (FIG. 2). Hoist linkages 42 extend in a more or less vertical position when the hoist arms are down, and also when the hoist arms are up, and swing somewhat out of the vertical at intermediate positions of the arms.

Operation of the hydraulic cylinders 48 will cause the hoist arms 40 to swing upwardly and downwardly.

In order to operate the lifting arms 38, lifting arm power means are provided in the form of hydraulic cylinders 50. Hydraulic cylinders 50 extend from a point located midway along the hoist linkages 42, and are connected to the rearward extensions **38*a* of the lifting arms 38**.

By the operation of these cylinders, the lifting arms may be swung towards and away from the rails.

In this particular embodiment of the invention, the trap door on top of the refuse container body is operated by means of an hydraulic cylinder 52 mounted on the body.

In operation, the lifting arms and roller carriages will be located at the forward lower ends of the rails. During driving of the vehicle, the lifting arms will be rotated upwardly and rearwardly along side the rails, thereby permitting free operation of the vehicle.

At the refuse collection site, the vehicle is lined up with the refuse receptacle. The lifting arms 38, by means of the lifting arm cylinders 50, are then rotated forwardly, until they are aligned with the sleeves 14 on the refuse receptacle 12. The vehicle is then driven slowly forward until the lifting arms 38 enter the sleeves 14.

The hoist arm cylinders 48 are then operated to raise the roller carriages up the rail. As the roller carriages move around the curved rails, the lifting arm cylinders 50 are operated so as to maintain the receptacle level.

Once the hoist arms 40 reach the limit of their travel, which is just past the vertical, the lifting arm cylinders are then operated so as to rotate the lifting arms rearwardly thereby tipping the receptacle and dumping its contents within the trap door in the refuse container body.

The lifting arms are then rotated in the reverse direction, and the hoist arms are then rotated in the reverse direction, thereby lowering the refuse receptacle on the ground. The vehicle then backs away, raises the lifting arms into the driving position, and drives away.

At some point in the operation, the compactors within the vehicle body are operated so as to compact the refuse.

When the body is filled, the vehicle may then be driven to a dump site. The rear door is then opened, and by means of the compacting and ejection device 22 the contents of the vehicle are ejected at he dump site.

Typically the hydraulic power means on the vehicle will consist of a pump, and various control valves (not shown) such as is well known in the art, and is usually, although not necessarily, operated by means of the prime mover of the vehicle, i.e., its main engine.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A front loading refuse vehicle of the type used in connection with a refuse receptacle at a refuse collection site, said vehicle comprising:

a front portion including a cab;

a rear portion adapted to carry refuse;

a pair of rails located on respective sides of said front portion, and defining forward rail portions extending upwardly in front of said cab and rearward portions extending rearwardly of said cab, and curved intermediate portions extending between said forward and rearward portions;

carriage means adapted to run on said rails between forward positions at the lower ends of sid forward rail portions, forward of said cab, and rearward positions at rear ends of said rearward rail poritons, rearwardly of said cab;

lifting arms moveably mounted on said carriage means and being adapted to engage said receptacle and lift the same:

hoist arms of a predetermined length pivotally mounted to the rearward ends of said rails for swinging between forward positions adjacent said rearward and intermediate rail portions, and upward positions extending at least perpendicularly upwardly;

hoist arm power means mounted on said vehicle and connected to said hoist arms for operating said hoist arms;

hoist linkage means of a predetermined length substantially equal to said length of said hoist arms, and extending therefrom in a forward position downwardly adjacent said forward rail portions, connecting between said hoist arms and said carriage means, and being moveable from said forward position to a reaerward positon substantially perpendicular alongside said hoist arms in their uprigth postions, whereby operation of said hoist arms and linkages will cause said carriage means to move along said rails from said forward position to said rearward position rearward of said cab, and, lifting arm power means mounted on said hoist arm linkage means and operable to swing said lifting arms away from and towards said rials, whereby said lifting arms are adapted to engage a refuse receptacle in front of said cab, and raise the same upwardly and transport same rearwardly along said rails to a point rearward of said cab.

2. A front loading refuse vehicle as claimed in claim 1 wherein hoist support frame means are provided rearwardly of said cab, for supporting said rearward portions of said rails.

3. A front loading refuse vehicle as claimed in claim 1, and including a refuse container body on said vehicle, a trap door swingably mounted on said container body, refuse compaction means within said container body, and wherein said trap door defines a forward, edge, wherein said hoist arms are pivotally mounted as aforsaid at points adjacent said forward edge of said trap door, said pivotal mounting points being secured relative to said vehicle, whereby said trap door may be swung independently of said hoist arms.

4. A front loading refuse vehicle as claimed in claim 3, including trap door power means for operating said trap door, said trap door power means being independent of said hoist arms.

* * * * *